US010773867B1

(12) United States Patent
Shah

(10) Patent No.: US 10,773,867 B1
(45) Date of Patent: Sep. 15, 2020

(54) ILLUMINATING CONTAINER HAVING AN INTERNAL STORAGE CAVITY AND A LIGHT SOURCE AND INTEGRATED CIRCUIT CONTAINED WITHIN A PORTION OF THE CONTAINER EXTERNAL TO THE INTERNAL STORAGE CAVITY

(71) Applicant: Rahul Shah, London (GB)

(72) Inventor: Rahul Shah, London (GB)

( * ) Notice: Subject to any disclaimer, the term of this patent is extended or adjusted under 35 U.S.C. 154(b) by 0 days.

(21) Appl. No.: 16/542,769

(22) Filed: Aug. 16, 2019

(51) Int. Cl.
*B65D 51/24* (2006.01)
*F21V 23/04* (2006.01)
*B65D 55/02* (2006.01)

(52) U.S. Cl.
CPC ..... *B65D 51/248* (2013.01); *B65D 55/02* (2013.01); *F21V 23/0464* (2013.01); *F21V 23/0492* (2013.01)

(58) Field of Classification Search
CPC ..... A45C 15/06; B65D 2583/0427; B65D 51/248
USPC ..... 362/154
See application file for complete search history.

(56) References Cited

U.S. PATENT DOCUMENTS

| | | | | |
|---|---|---|---|---|
| 5,178,450 | A | 1/1993 | Zelensky et al. | |
| 5,743,620 | A * | 4/1998 | Rojas | A47G 19/2227 362/101 |
| 6,254,247 | B1 | 7/2001 | Carson | |
| 6,271,753 | B1 | 8/2001 | Shukla | |
| 6,923,549 | B2 * | 8/2005 | Hoy | A47G 19/2227 362/101 |
| 7,976,177 | B2 | 7/2011 | Dikopf | |
| 8,210,395 | B1 | 7/2012 | Morris | |
| 9,821,937 | B2 | 11/2017 | Staeben et al. | |
| 2004/0004829 | A1 | 1/2004 | Policappelli | |
| 2005/0024858 | A1 | 2/2005 | Johnson | |
| 2006/0139928 | A1 | 6/2006 | Griffiths et al. | |
| 2007/0103895 | A1 * | 5/2007 | Riesebosch | F25D 27/00 362/154 |
| 2007/0217187 | A1 * | 9/2007 | Blakely | F25D 27/00 362/154 |
| 2010/0308005 | A1 | 12/2010 | Callanan | |
| 2012/0134143 | A1 | 5/2012 | Lederer et al. | |
| 2015/0036325 | A1 | 2/2015 | Cohen | |
| 2015/0211729 | A1 | 7/2015 | Mahlmeister et al. | |
| 2018/0126138 | A1 * | 5/2018 | White | B65D 50/04 |

FOREIGN PATENT DOCUMENTS

| | | | |
|---|---|---|---|
| CN | 107336906 | A | 11/2017 |
| DE | 20 2010 015 591 | | 3/2011 |
| FR | 3 008 961 | A1 | 1/2015 |
| WO | 2015003331 | A1 | 1/2015 |

* cited by examiner

*Primary Examiner* — Robert J May
(74) *Attorney, Agent, or Firm* — Lambert Shortell & Connaughton; Gary E. Lambert; David J. Connaughton, Jr.

(57) ABSTRACT

An illuminating container is provided. The illuminating container allows inspection of the contents of an opaque body to provide a desirable and pleasant illumination of the contents within the container. Typically, the illumination may be triggered automatically by a sensor, though in other embodiments may be triggered by a manual switch.

21 Claims, 6 Drawing Sheets

ILLUMINATING CONTAINER HAVING AN INTERNAL STORAGE CAVITY AND A LIGHT SOURCE AND INTEGRATED CIRCUIT CONTAINED WITHIN A PORTION OF THE CONTAINER EXTERNAL TO THE INTERNAL STORAGE CAVITY

BACKGROUND OF THE INVENTION

Field of the Invention

The present disclosure relates generally to containers. More particularly the present disclosure relates to a container which has a light source in a body or a cover to illuminate contents stored within the container.

Description of Related Art

*Cannabis* for end-user consumption is typically packaged inside an opaque container, and usually with a child-proof safety cover. In many instances, this is required by law. However, due to this regulation it can be difficult for consumers to identify the product even when the package is opened. This is particularly the case for patients who suffer from sight related issues, for example, Glaucoma, where patients' sight can be weak, blurry and/or suffer from visual disturbance, often in low light.

Another concern for patients is taking the correct dosage of the *cannabis* itself. With current opaque packaging containers, due to the dark internal environment, it is common for patients to take more than what might be the required dosage.

Another problem with opaque packaging relates to the overall sales and marketing approach to *cannabis* as of recently. It has been observed that *cannabis* products are often demonstrated and marketed to consumers in a similar manner as diamonds and jewelry in retail environments—i.e. careful handling of the merchandise and presentation in a highly lit environment (most times under a super white spotlight)—all in order to demonstrate the colors, hues and amount of visible THC/CBD (otherwise known as 'crystals') that vary between different strains, up close to the potential consumer.

In addition to this method of in-store selling and marketing, it has been observed that most marketing related materials (e.g. posters, billboards, websites, magazines) contain zoomed in shots of the product (i.e. the *cannabis* buds) in order to highlight the colors, hues, and visible crystals that vary between the different strains of *cannabis*. However, when it comes to opening the containers and seeing the product itself, the visual appearance of the buds will never match what is being marketed due to the dark internal environment of the container.

Therefore, what is needed is a system that can provide visual inspection of *cannabis* inside the opaque container.

SUMMARY OF THE INVENTION

The subject matter of this application may involve, in some cases, interrelated products, alternative solutions to a particular problem, and/or a plurality of different uses of a single system or article.

In one aspect, an illuminating container is provided. The container comprises a body comprising an opaque material. A cover is attachable to the container body. The cover allows access to a body interior space when in an open position, and prevents access to the body interior space when in a closed position. Within the body is an inner wall which separates electronics components, including a light, from a storage cavity defined by the inner wall. The inner wall has at least a portion formed of a transparent or translucent material allowing the light to pass through the inner wall to the storage cavity. In many embodiments, the inner wall is formed entirely of the transparent or translucent material.

In another aspect, an illuminating *cannabis* container is provided. The container comprises a body comprising an opaque material. A cover is attachable to the container body. The cover allows access to a body interior space when in an open position, and prevents access to the body interior space when in a closed position. The cover is threadedly connectable to the body, and when connected thereto, forms a child safety lock such as that of prescription bottles and certain household chemicals. Within the body is an inner wall which separates electronics components, including a light, from a storage cavity defined by the inner wall. The inner wall has at least a portion formed of a transparent or translucent material allowing the light to pass through the inner wall to the storage cavity. In many embodiments, the inner wall is formed entirely of the transparent or translucent material. The container further has a quantity of *cannabis* plant material within the storage cavity. Upon illumination of the light, the *cannabis* plant material can be easily inspected, evaluated, displayed, and properly dosed.

In yet another aspect, an illuminating *cannabis* container is provided. The container comprises a body which may be transparent, translucent, or opaque. A cover is attachable to the container body. The cover allows access to a body interior space when in an open position, and prevents access to the body interior space when in a closed position. The cover is threadedly connectable to the body, and when connected thereto, forms a child safety lock. A plurality of electronics components are positioned in the cover with a light of the electronics components directed into the body interior space. The electronics components further comprise a battery and an integrated circuit such as a processor operating as a controller in electronic communication with the battery and light. Upon receipt of an input from a switch, the integrated circuit is operable to activate the light for a predetermined period of time. The container further has a quantity of *cannabis* plant material within the storage cavity. Upon illumination of the light, the *cannabis* plant material can be easily inspected, evaluated, displayed, and properly dosed.

DETAILED DESCRIPTION

Figure 1:
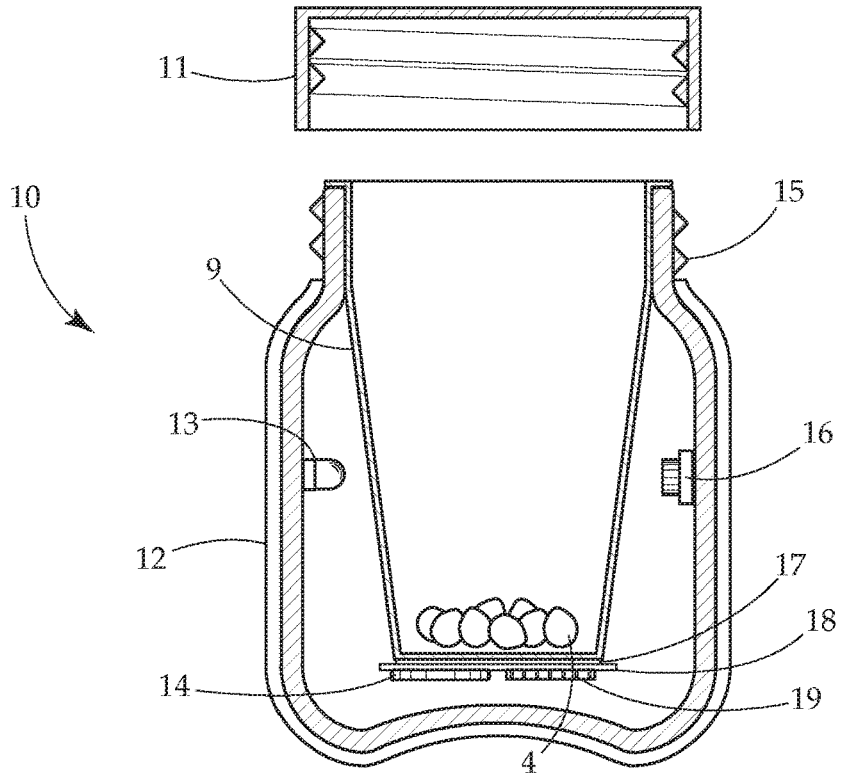
FIG. 1 provides a side cutaway view of an embodiment of the container disclosed herein.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

Generally, the present disclosure concerns a container which includes illuminating components in its body or in a cover. In many embodiments, the illuminating container is designed for use in storage of *cannabis*. Such containers typically are made of a container body having opaque material such as an opaque outer layer to prevent visual inspection from the outside. Accordingly the illumination provided by the present disclosure allows the contents of the container (typically *cannabis*) to be illuminated, allowing for optimal visual inspection of the container contents as well as a pleasant visual presentation of the contents therein. While often discussed applied to opaque containers, the present illuminating system may also be applied in certain embodiments to transparent or translucent containers as well.

One goal of certain embodiments the present disclosure is to improve the way *cannabis* is packaged and presented to consumers and patients. *Cannabis* stored in the present inventive containers can be more easily viewed, such that colors, hues, and crystals can be visible while in the container. This allows for better display and inspection of the product in a dispensary or other purchase location. Also, once purchased, it provides easier viewing of the product for dosing, quality, and quantity evaluation. Through the use of the inventive containers, producers, brands, and consumers/patients will be able to easily identify the different strains that are available, and the consumer/patient is better enabled to take the correct dosage versus what they may measure without the illumination inside the container. Moreover, in a sales setting, the illuminating container may be used to increase the speed of transactions. Instead of a vendor removing *cannabis* from a container and displaying it to the customer, the vendor can simply open the container, and with the light activated, showcase the features of the *cannabis* contained therein.

In one embodiment, the illuminating container is formed generally by a container body comprising an opaque outer wall. Electronics components which allow operation of the lighting features are located within an interior space of the body. In this embodiment, an inner wall separates the electronics components, including a light, from a storage cavity, such that the items stored in the container do not interfere with or become mixed with the electronics components. The inner wall, in many embodiments, may be removable from the body to access the electronics components though in other embodiments is permanently attached. A cover is attachable to the body to prevent access to an interior space of the body when in a closed position, and allow access when in an open position. In many embodiments, the cover may be a child lock cover or other secure cover to prevent access by children.

In many instances, the opaque container embodiments may be formed of an opaque material such as plastic, paper, metal, glass, ceramic, and the like, though in other embodiments, the container may be made opaque by a paint, plastic or other wrap, and the like. As will be understood by those in the art, the opaque container may let a negligible amount of light through, but nevertheless the contents of the container cannot be inspected visually from the outside of the container. The container may be of any size and shape, without straying from the scope of this invention.

In another embodiment, electronics components may be positioned on or in the cover. In such an embodiment, the light may emanate from the cover into the body interior space when the light is activated.

In many embodiments, a switch may control activation of the light within the body/cover. In further embodiments, the light may be programmed to activate for a predetermined period of time, and then shut off upon activation of the switch. Sensor switches may, in some embodiments, be used to automatically detect removal of the cover from the body, which indicates that the container is being opened. Upon detection of removal, the light may be turned on. Examples of such sensor switches may include, but are not limited to pressure sensors, magnetic sensors, photo sensors, and proximity sensors, among others. In other embodiments, manual switches such as buttons, toggle switches, and the like allow for manual activation of the light.

The inner wall of certain embodiments may be formed of a plastic or other material which separates stored contents of the container from electronic components to provide illumination. Generally, some or all of the inner wall material is translucent or transparent so as to provide optimal illumination. In a particular embodiment used for storing and illuminating *cannabis*, it was found that a transparent inner wall, such as transparent plastic, reflected lighting within the container and allowed for optimal reflection off crystals and other components of the *cannabis*. This highlights the desirable components (crystals and other colored elements) of the *cannabis* making them more visible to the naked eye.

In some embodiments, the inner wall may include score marks, protrusions, or other markings to indicate different fill levels. For example, score lines may be placed at 25%, 50%, and 75% full. Though, the positioning and number of markings may vary in different embodiments. These markings may be positioned on the inner wall itself, or may be visible through a transparent inner wall and may be positioned on the container or an adjacent layer near the transparent inner wall. While not easily visible without the internal illumination of the container, once the illumination is activated, the markings can be easily viewed.

The light can be positioned anywhere in the body or cover. In many instances, a light positioned along a side of the body approximately half way between the bottom and the top of the body was found to be ideal. The light may be any light or plurality of lights capable of illuminating the interior space of the container. This may include, but is not limited to white or colored light emitting diodes (LED), as well as other light sources known in the art. In one particular embodiment, the light may be operable to provide approximately 150-350 lux.

Electronics components to control the lighting may include but are not limited to, in addition to the light and among others, a battery, an integrated circuit, printed circuit board assembly, and/or a switch, among other options.

Overall, the present container, especially when used for storing and illuminating *cannabis*, provides advantageous illumination for the common opaque packaging allowing display, viewing, and presentation of *cannabis* stored therein. The lighting is preferably designed to highlight desirable components of the *cannabis* such as crystals, as well as the various colors and hues of the particular *cannabis* type. The lighting is further operable to allow proper dosing, allowing a user to obtain the desired amount, as well as allowing a viewing of how much *cannabis* remains in the package.

Turning now to FIG. 1, a side cutaway view of an embodiment of the container is provided. The container 10 is formed of an opaque layer 12 covering a body 15, shown here as a jar. Though as noted above, the opaque material may vary. A child-safety cover 11 is threadably connected to the top of the body 15, preventing access to the interior space of the container 10 when threadedly attached in a closed position, and allowing access when removed in an open position. An inner wall 9 separates the electronics components (13, 14, 16, 17, 18, 19) from the storage cavity defined by the inner wall 9. In this view, within the storage cavity is a quantity of *cannabis* 4. The electronics components operate together to illuminate the container. A light 13 is shown in this embodiment at a side and middle area of the body 15. However it should be understood that one or more lights may be used, and may be positioned at various locations. Connected to the light 13 is an integrated circuit 19, operable as a controller, which is mounted to circuit board 18. The circuit board 18 is, in this embodiment, mounted to a bottom of the inner wall 9 via two sided tape 17. A battery 14 provides electrical energy to illuminate the light 13. A switch, in this embodiment a photo sensor 16, is in communication with the integrated circuit 19. Upon detection of a predetermined level of light from the outside (which indicates that the cover 11 has been removed), the photo sensor 16 provides a signal to the integrated circuit 19 which in turn activates the light 13. The light 13 may remain active until the photo sensor 16 no longer detects the light from outside, or may remain on for a predetermined amount of time, among other options.

Figure 2:
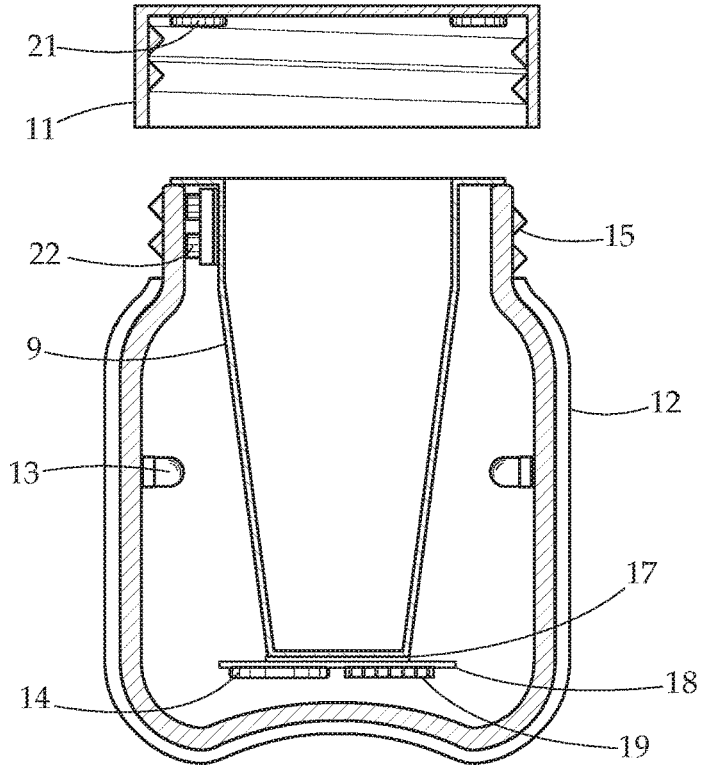
FIG. 2 provides a side cutaway view of another embodiment of the container.

FIG. 2 shows a side cutaway view of another embodiment of the container. This embodiment is similar to the embodiment of FIG. 1, however instead of the photo sensor 16, a magnetic sensor 22 is used. The magnetic sensor 22 is in communication with the integrated circuit 19. One or more magnets 21 is positioned on the cover 11. When the magnetic sensor 22 senses that the magnets 21 are not present (indicating that the cover has been removed) it provides a signal to the integrated circuit 19 which in turn activates the light 13. The light 13 may remain active until the magnetic sensor 22 detects a magnet again, or may remain on for a predetermined amount of time, among other options. The embodiment shown in FIG. 2 utilizes a plurality of lights 13 for illuminating the container.

Figure 3:
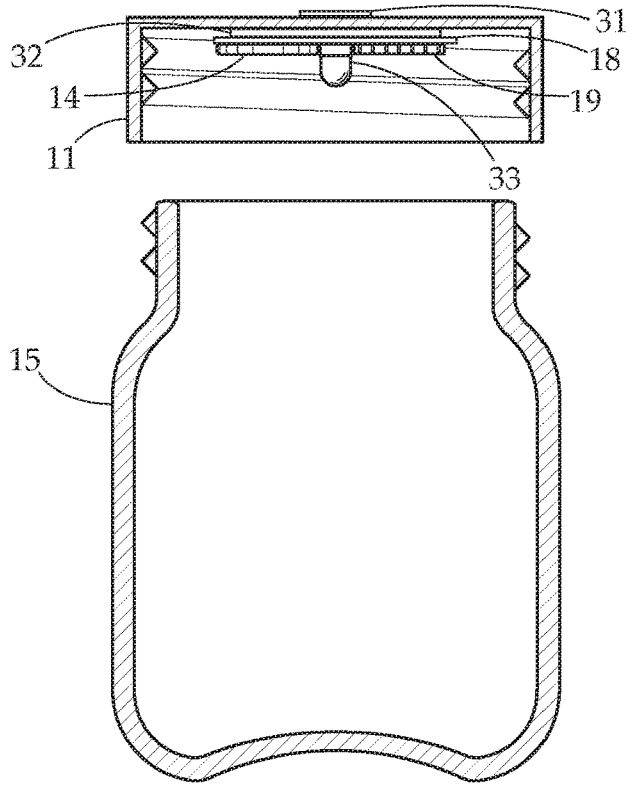
FIG. 3 provides a side cutaway view of yet another embodiment of the container.

FIG. 3 shows an embodiment of the container having the lighting and related electronics components housed in the cover 11. In this view, body 15 is often formed of an opaque material, but in other embodiments may be translucent or transparent. The cover 11 is connectable to the body 15 via a threaded connection, and in most embodiments, a child-proof connection. In the cover 11 is a light 33, as well as a button switch 31 to turn the light 33 on. In this embodiment, an adhesive 32, such as double sided tape, is used to join the circuit board 18 and the integrated circuit 19 connected thereto to the cover 11. In use, a user may remove the cover 11, activate the light using button 31, and then manipulate the cover to shine the light into the body 15 to illuminate the contents therein. Of course, switch embodiments discussed elsewhere in this disclosure relating to automatic switches, among others, may also be used in the cover-based embodiments.

Figure 4:
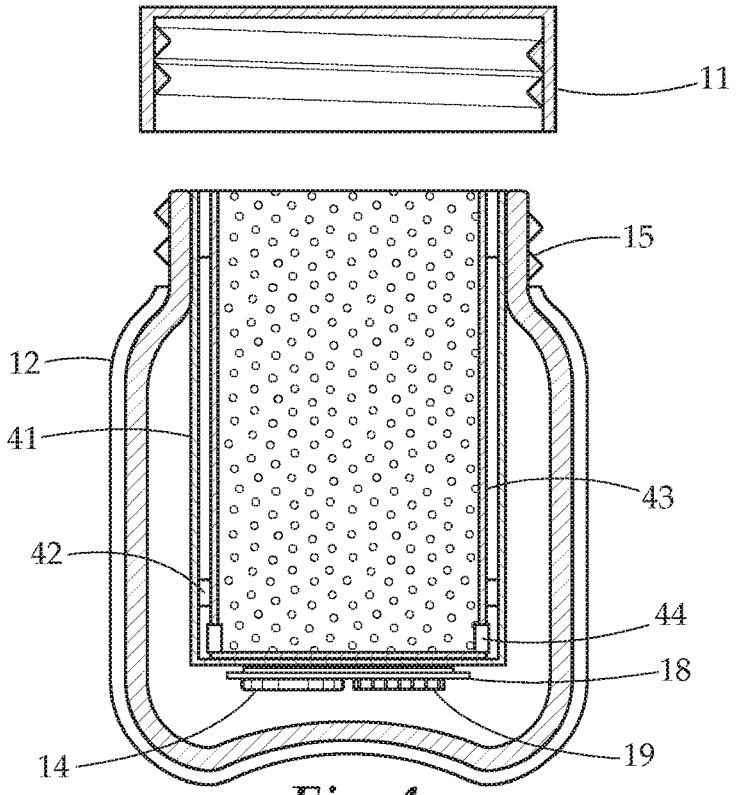
FIG. 4 provides a side cutaway view of still another embodiment of the container.

FIG. 4 provides a view of yet another embodiment of the container. In this view, the inner wall 43 is covered by a secondary opaque covering 41 which prevents light which may pass through the body 15 (in this embodiment having opaque layer 12) from accidentally triggering a photo sensor (not shown). The opaque covering 41 thus provides a second barrier between the photo sensor and the outside environment. The opaque covering 41 also operates, in certain embodiments, to hide the electronics components from view when looking into the container. In many embodiments the opaque covering 41 may be made of a black paper or other similar opaque material. A spacer 42 positions the opaque covering 41 from a light-porous inner wall 43. The inner wall 43, in this embodiment, is formed of a plastic layer which has a plurality of openings or transparent areas to allow light from one or a plurality of LEDs 44 into the interior storage cavity defined by the inner wall 43. As in other embodiments, the electronics components, here comprising battery 14, circuit board 18 and the integrated circuit 19 connected thereto, as well as a photo sensor in communication with the circuit board 18 and integrated circuit 19 control activation of the light when the cover 11 is removed.

Figure 5:
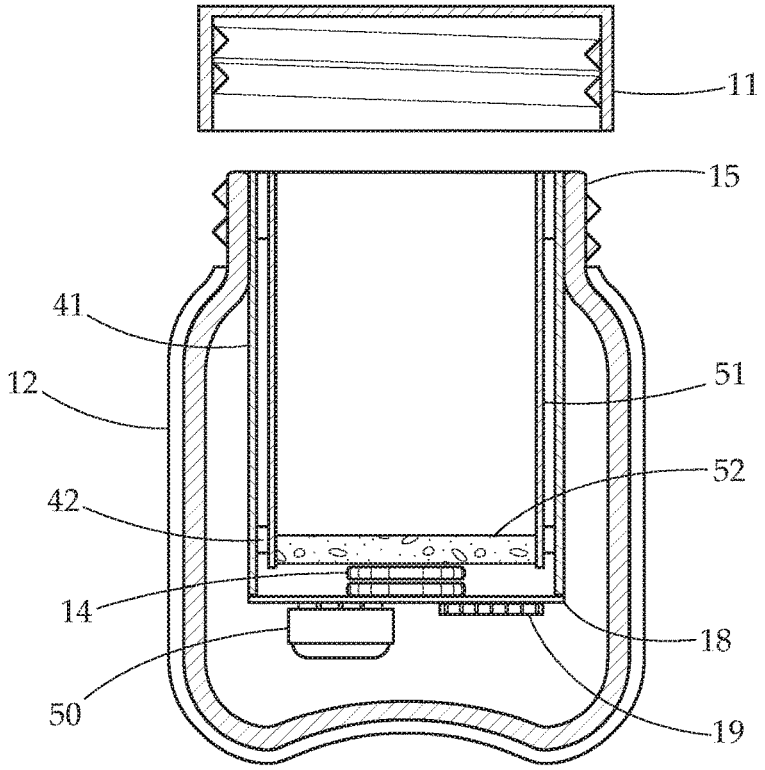
FIG. 5 provides a side cutaway view of still yet another embodiment of the container.

FIG. 5 provides still another embodiment of the container. In this embodiment, an electro-luminescence (EL) panel is formed into a cylinder to define the inner wall 51 as well as providing illumination. In this embodiment, the floor of the inner wall is formed of a sponge 52 to diffuse light from the EL panel inner wall 51. A spacer 42 separates the EL panel inner wall 51 from an outer opaque covering 41 which is advantageous for photo sensor triggered solutions to activate the lighting because the photo sensor is blocked from the light by both the opaque container 10 and the opaque covering 41. Batteries 14 provide power to the EL panel 51 via micro transformer 50. The circuit board 18 and the integrated circuit 19 provide control operation for the lighting as activated by a switch, which may be a photo sensor, magnetic sensor, and the like.

Figure 6:
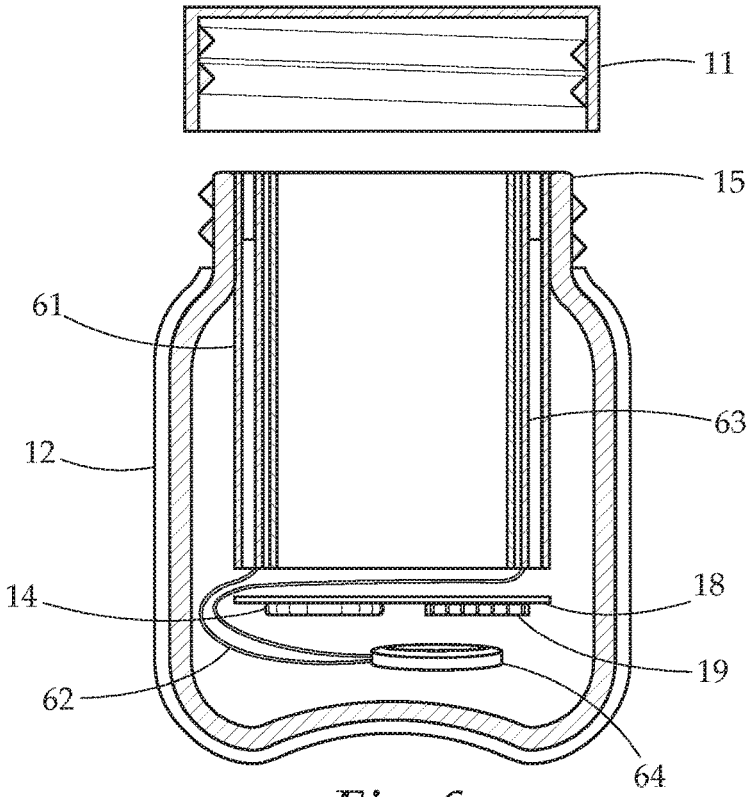
FIG. 6 provides a side cutaway view of another embodiment of the container.

FIG. 6 provides yet another embodiment of the container. In this view, a fiber optic wire or wires is integrated into the inner wall to provide illumination. The container is similar in structure to that of FIG. 5, with the lighting arrangement being different. In this embodiment, a fiber-optic woven material is formed into the inner wall 63. The fiber optic wire or wires provide the illumination on the wall itself. Fiber optic wires 62 extend from the inner wall to a LED source 64 to provide source lighting. In photo sensor triggered embodiments, such as that shown, a secondary opaque covering 41 provides an additional light-blocking barrier between the body 15 and opaque layer 12 and the photo sensor (not shown).

Figure 7:
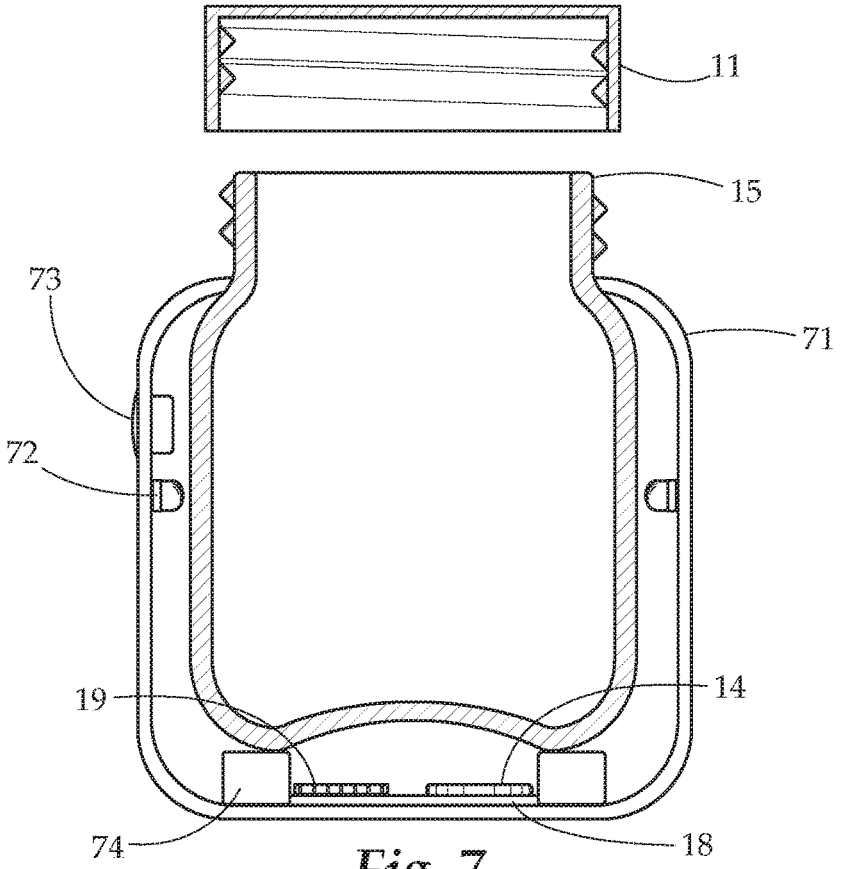
FIG. 7 provides a side cutaway view of yet another embodiment of the container.

FIG. 7 provides a view of an embodiment of the container having an opaque wrapping and all of the electronics components on an exterior of a transparent or translucent body. In this embodiment, a body 15 of the container, shown here as a jar, is formed of a transparent or translucent material. Cover 11 again is connectable to open and close the body interior space. A flexible opaque layer 71 can be attached to the jar to prevent light from entering and prevent visual inspection of the body's 15 contents. Within this opaque layer 71 are the electronics components to provide lighting to the body 15 interior. A ring shaped spacer 74 elevates the body 15 away from the electronics components which are within the ring 74. This includes circuit board 18, battery 14, and integrated circuit 19. A light 72 is positioned to be located on a side of the jar approximately halfway from its bottom when attached. The light is controlled by button switch 73 which is in communication with the integrated circuit 19, as is the button 73. The flexible opaque layer 71 may be in many different configurations. In one embodiment, the layer 71 may be formed as a sleeve or sock, which is flexible and can slide over the body 15. In another embodiment, the layer 71 may be wrapped or bunched around the body 15 and then secured in place around an upper area of the body 15.

Figure 8:
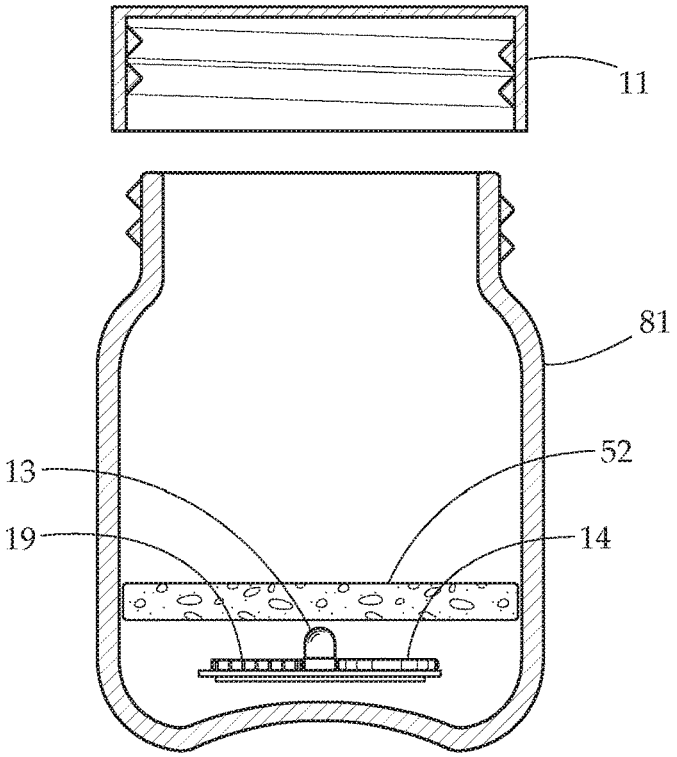
FIG. 8 provides a side cutaway view of another embodiment of the container.

FIG. 8 provides a view of still yet another embodiment of the container having a light source at a bottom of the container. In this view, an opaque body 81 forms the container body, and cover 11 is connectable to the opening of the body 81. An inner wall 52 in this embodiment extends across a cross section of the body 81 above a bottom of the body 81. In this embodiment, inner wall 52 is formed of a sponge material which may diffuse the light and at the same time separate material stored in the storage cavity of the body 81 from the electronics components. However, any at least partially transparent or translucent material may be used in place of the sponge. Electronics components are positioned below the inner wall 52 to provide illumination. In this embodiment, light 13, circuit board 18, battery 14, and integrated circuit are in electronic communication and attached to the body 81. A switch (not shown) may control activation of the light 13, as discussed above.

Figure 9:
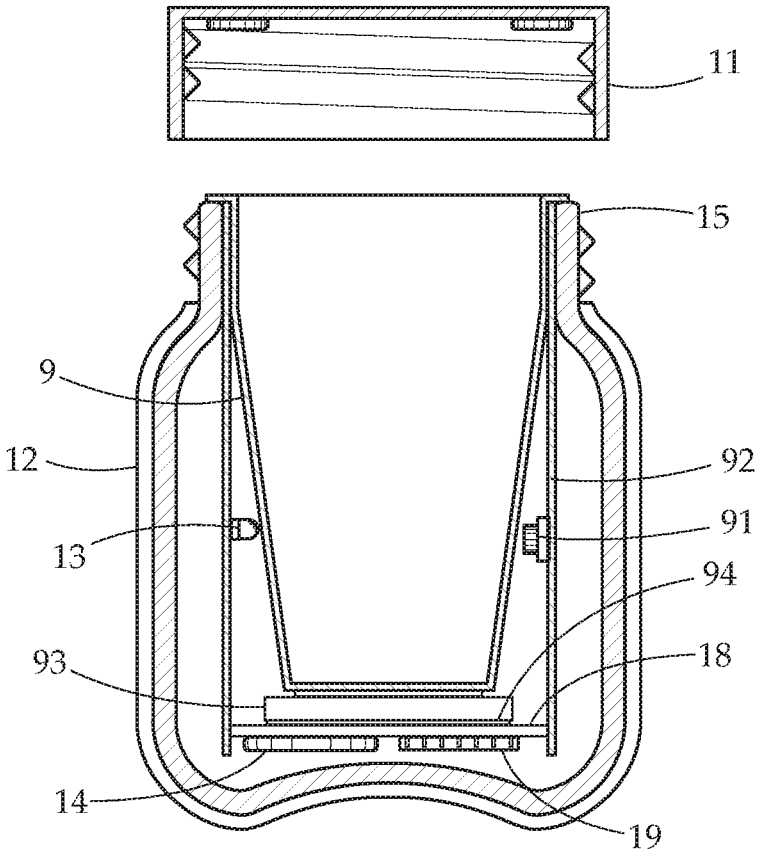
FIG. 9 provides a side cutaway view of yet another embodiment of the container.

FIG. 9 provides another embodiment of the container which provides a sound output as well as illumination. In this embodiment, a body 15 has an opaque layer 12 covering it, and a cover 11 attachable to its opening. Inner wall 9 separates the electronics components (13, 14, 16, 17, 18, 19) from the storage cavity defined by the inner wall 9. An opaque covering 92 surrounds the inner wall 9 to limit light entry to prevent accidental triggering of the photo sensor 91. As in other embodiments, circuit board 18, battery 14, and integrated circuit 19 are in communication with the light 13 and photo sensor 91. Upon receipt of a signal from photo sensor 91, the integrated circuit 19 is operable to activate the light 13. In this embodiment, the integrated circuit 19 is operable to activate the light 13 for a predetermined period of time. Further, a speaker or buzzer 94 is also in communication with the integrated circuit 19. As with the light 13, upon receipt of a signal from photo sensor 91, the integrated circuit 19 is operable to activate the speaker or buzzer 94 to provide a pleasant audible output when viewing the contents of the container.

Figure 10:
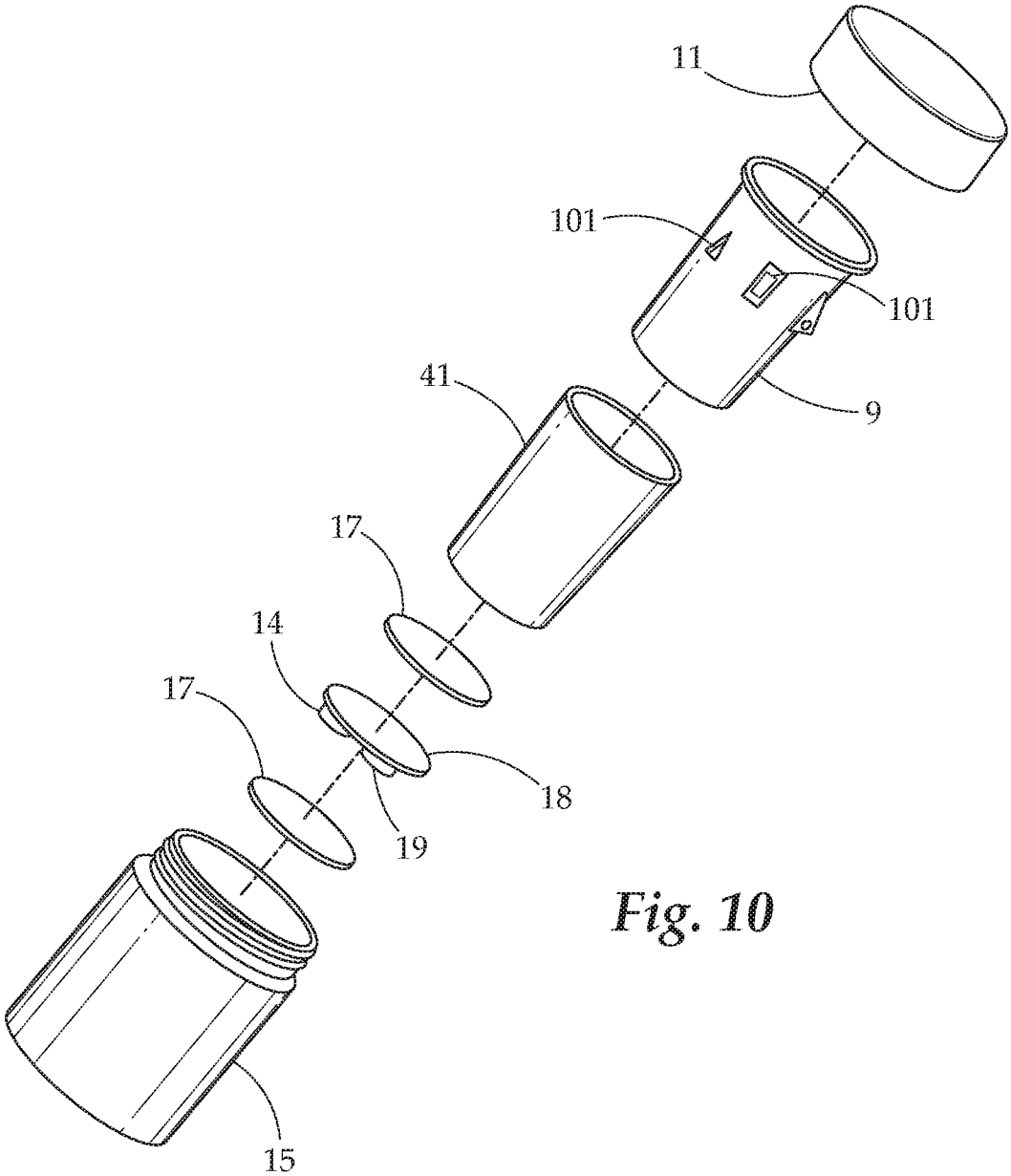
FIG. 10 provides an exploded view of an embodiment of the container.

FIG. 10 provides an exploded view of an embodiment of the container. A body 15 has electronics components including battery 14, integrated circuit 19 and circuit board 18 held in place by two layers of adhesive such as double sided tape 17. An opaque covering 41 surrounds the inner wall 9. On the inner wall are openings for light entry from the light source (not shown). Cover 11 is attachable to the body 15 and allows access to its interior. In this embodiment, the inner wall 9 has depressions 101 on the outer surface. When assembled, the lights can extend into these depressions. This arrangement allows the lights to be positioned inward, for example radially inward, from the edge of the rest of the inner wall. It has been found that this positioning of the light provides enhanced illumination of the contents because it can provide not only lateral illumination, but also upward and/or downward illumination. This inner wall 9 embodiment may, of course, be applied to any other embodiment of the container.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth.

What is claimed is:

1. An illuminating container comprising:

a body comprising a bottom and at least one side wall extending from the bottom, the bottom and the at least one side wall defining a body interior space;

a cover attachable to the body, the cover allowing access to the body interior space when in an open position, and preventing access to the body interior space when in a closed position;

at least one inner wall within the body interior space, the inner wall spaced from at least one of the at least one side wall and the bottom of the body the inner wall defining a storage cavity in the interior body space;

wherein the inner wall separates electronics components within the body interior space from the storage cavity defined by the inner wall, and wherein at least a portion of the inner wall is at least one of: transparent and translucent and wherein the electronics components comprises a light.

2. The illuminating container of claim 1 wherein the electronics components further comprises a battery, and an integrated circuit in electronic communication with the battery and the light.

3. The illuminating container of claim 2 further comprising a photo sensor in communication with the integrated circuit, the integrated circuit operable to cause the light to illuminate for a predetermined time period when the photo sensor detects a predetermined level of light.

4. The illuminating container of claim 3 further comprising a secondary opaque layer between the body and the photo sensor.

5. The illuminating container of claim 2 further comprising a magnet positioned in the cover, and the body comprising a magnetic sensor in communication with the integrated circuit, the integrated circuit operable to cause the light to illuminate for a predetermined time period when the magnetic sensor detects a removal of the magnet of the cover.

6. The illuminating container of claim 2 further comprising a switch in communication with the integrated circuit, the integrated circuit operable to cause the light to illuminate when the switch is activated.

7. The illuminating container of claim 1 wherein the light is positioned along a side of the body interior space.

8. The illuminating container of claim 1 further comprising markings to indicate different fill levels positioned on one of the inner wall, a body inner surface, and an opaque covering between the inner wall and the body inner surface, wherein the markings are visible upon an activation of the light.

9. The illuminating container of claim 1 wherein the light extends about at least a portion of a perimeter of the body interior space.

10. The illuminating container of claim 1 wherein the light is one of a LED, a plurality of LEDs, an electro-illuminance panel, and a fiber optic weaved material.

11. The illuminating container of claim 1 wherein the body comprises a glass jar with an opaque layer on an exterior of the jar.

12. The illuminating container of claim 1 wherein the light is positioned to illuminate a contents of the container.

13. The illuminating container of claim 1 wherein the cover forms a child safety lock when connected to the body in the closed position.

14. An illuminating *cannabis* container comprising:

a body;

a cover attachable to the body, the cover allowing access to a body interior space when in an open position and preventing access to the body interior space when in a closed position, wherein the cover is threadedly connectable to the body, and wherein the cover forms a child safety lock when connected to the body;

an inner wall within the body interior space, the inner wall separating electronics components within the body interior space from a storage cavity defined by the inner wall, wherein at least a portion of the inner wall is at least one of: transparent and translucent;

wherein the electronics components comprises a light; and a quantity of *cannabis* plant material within the storage cavity.

15. The illuminating *cannabis* container of claim 14 wherein the electronics components further comprises a battery, and an integrated circuit in electronic communication with the battery and the light.

16. The illuminating *cannabis* container of claim 15 further comprising a switch in communication with the integrated circuit, the integrated circuit operable to cause the light to illuminate when the switch is activated.

17. The illuminating *cannabis* container of claim 14 wherein the light is positioned along a side of the body interior space.

18. The illuminating *cannabis* container of claim 14 wherein the light is one of a LED, a plurality of LEDs, an electro-illuminance panel, and a fiber optic weaved fabric.

19. The illuminating *cannabis* container of claim 14 wherein the light is a white LED light, and wherein light is positioned along a side of the body interior space to allow inspection of the quantity of *cannabis* plant material.

20. An illuminating *cannabis* container comprising:

a body;

a cover attachable to the body, the cover allowing access to a body interior space when in an open position and preventing access to the body interior space when in a closed position, wherein the cover is threadedly connectable to the body, and wherein the cover forms a child safety lock when connected to the body;

a plurality of electronics components positioned on a lower surface of the cover directed into the body interior space, wherein the electronics components comprise a light, a battery, and an integrated circuit in electronic communication with the battery and the light, the integrated circuit operable to receive an input from a switch and operable to activate the light for a predetermined period of time;

a quantity of *cannabis* plant material within the body interior space.

21. The illuminating *cannabis* container of claim 20, wherein the body is formed of transparent material.

* * * * *